United States Patent [19]

Smith et al.

[11] Patent Number: 5,014,360

[45] Date of Patent: May 14, 1991

[54] REMOVING PERSPIRATION

[76] Inventors: Eileen M. Smith, 437 Peakham Rd.; Henry I. Smith, 437 Peakham Rd., Sudbury, Mass. 01776

[21] Appl. No.: 503,389

[22] Filed: Apr. 2, 1990

[51] Int. Cl.[5] ..... A41B 1/00; A41B 1/08

[52] U.S. Cl. ..... 2/115; 2/125; 2/46

[58] Field of Search ..... 2/115, 125, 46

[56] References Cited

U.S. PATENT DOCUMENTS

| | | | |
|---|---|---|---|
| 2,858,541 | 11/1958 | Mangan | 2/113 |
| 3,122,754 | 3/1964 | Wedin | 2/113 |
| 3,174,156 | 3/1965 | Dale et al. | 2/115 |
| 3,281,863 | 11/1961 | Beard et al. | 2/113 |
| 4,121,302 | 10/1978 | Belpaume | 2/113 |
| 4,170,793 | 10/1979 | O'Brien | 2/113 |
| 4,501,025 | 2/1985 | Kuznetz | 2/113 |
| 4,541,129 | 9/1985 | Murakami | 2/113 |
| 4,603,440 | 8/1986 | Hale | 2/115 |
| 4,768,236 | 9/1988 | Klob | 2/115 |

*Primary Examiner*—Werner H. Schroeder
*Assistant Examiner*—Gloria Hale
*Attorney, Agent, or Firm*—Fish & Richardson

[57] ABSTRACT

A jersey or shirt of lightweight material with left and right short sleeves has moisture-absorbent material at least on the front panel of at least one sleeve.

16 Claims, 2 Drawing Sheets

REMOVING PERSPIRATION

Figure 2:
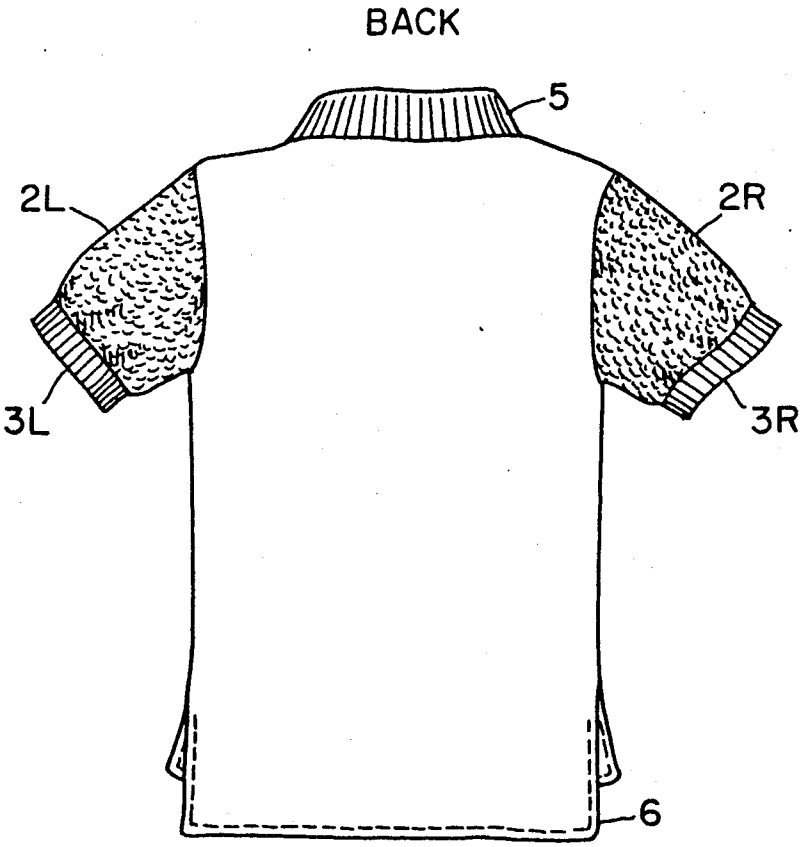

The present invention relates in general to removing perspiration and more particularly concerns removing perspiration by sports participants during a sports event.

In the conduct of sports such as tennis it is frequently necessary for participants to remove perspiration or sweat from the region around their eyes because excessive buildup of perspiration there may interfere with vision. Frequently it is necessary to remove excess perspiration during active play. In tennis a number of devices are available to wipe the brow, including a towel attached to one's belt or inserted in the pocket, terry cloth cuffs extending about six inches along the forearm or absorbent wrist bands made of such material as elasticized terry cloth. Wrist band devices can be used to wipe the brow but are intended primarily to reduce the amount of sweat running down the forearm onto the hand where excess moisture can interfere with proper grip of the tennis racket.

Some players use absorbent sweat bands on their brows. However, many players find the sweat band to be uncomfortable. The sweat band tends to keep the head hot and impede the biological purpose of perspiration to cool the head. The sweat band is typically worn high on the forehead where it cannot absorb sweat around the eyes, below the sweat band.

According to the invention, there is highly absorbent material on at least one sleeve of the jersey. The material is preferably on the front of the sleeve. Preferably the sleeve is short and ends at or above the elbow. Preferably the jersey or shirt is made of lightweight material of moisture absorbing capacity significantly less than that of the highly absorbent material, such as terry cloth, preferably stretch terry cloth which is a composition of substantially 60% cotton, 20% polyester and 20% lycra. The absorbent material may comprise a removable panel, a fastener detachably securing the absorbent material to the at least one sleeve. To dry the right side of the brow the player merely lowers the head to the right and raises the right arm to slightly above head level and presses the brow against the absorbent material. The same motion can be repeated on the left side. These motions can be carried out even if the hands are not free, as is frequently the case in sports such as tennis.

The commonly available tennis jerseys are made of light cotton or synthetic materials and do not provide much capacity for drying the brow. The conventional tennis jersey is easily stained and damaged by the repeated action of wiping the brow with the upper sleeve without the invention. Sweat leads to acidic degradation of fibers such as cotton used in typical sport jersey construction. The current invention solves both of these problems by fabricating the upper sleeve of a moisture-absorbing material, such as terry cloth, or providing a panel of such material on the front of the upper sleeve. The terry cloth of the upper sleeve does not increase the discomfort of the player because this part of the human body does not produce a great deal of heat as, for example, the head and chest regions produce. Furthermore, if the absorbent material is stretch terry cloth, it will not restrict motion of the arms. The remainder of the jersey may be made of light materials similar to those used in conventional sports jersey construction. The sleeve with the highly absorbent material is preferably a short sleeve extending down approximately just past the biceps.

Figure 1:
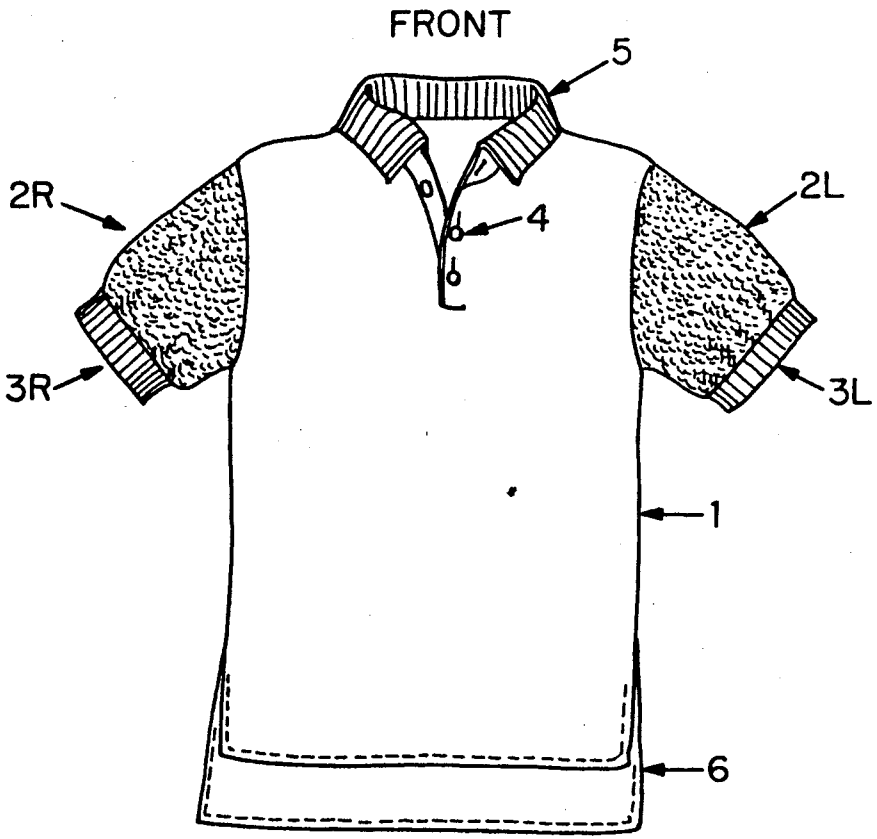
Figure 4:
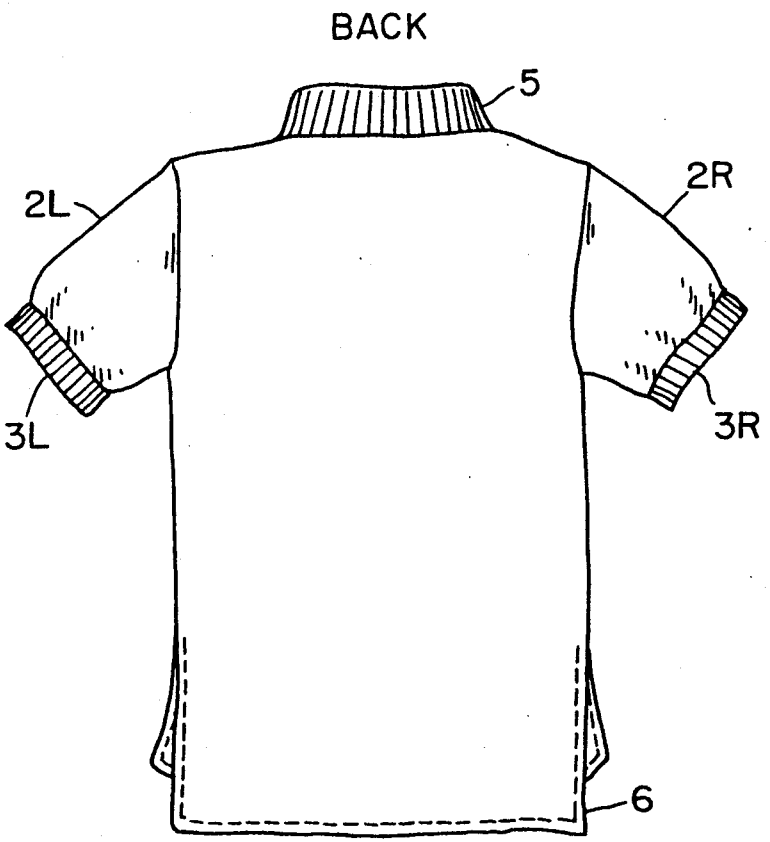
Figure 3:
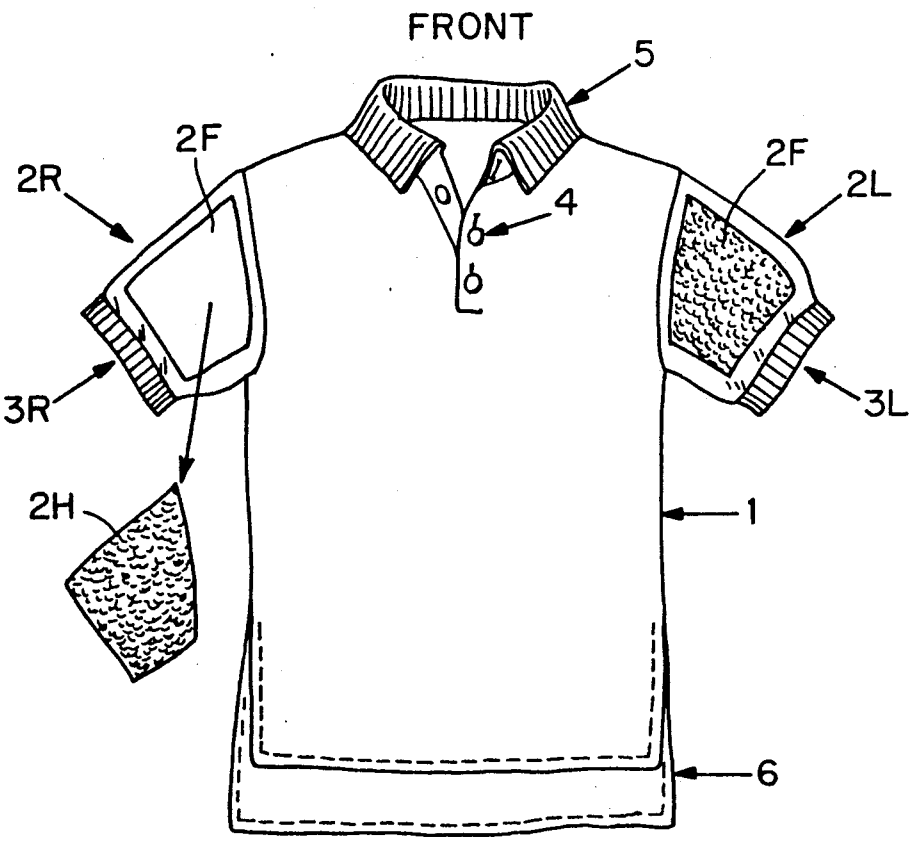

Other features and advantages will become apparent from the following detailed description when read in connection with the accompanying drawings in which:

FIGS. 1 and 2 are front and rear views, respectively, of a jersey according to the invention; and FIGS. 3 and 4 are front and rear views, respectively, of alternate embodiments of the invention with highly absorbent material on only the front panel of each sleeve and one panel of highly absorbent material detachably secured to the sleeve front panel.

With reference now to the drawings and more particularly FIGS. 1 and 2 thereof, there are shown front and rear views, respectively of a jersey or shirt constructed in accordance with the invention. The jersey includes a main body portion 1 constructed typically of 100% cotton, although other materials can also be used as in typical sport shirt construction. The right upper sleeve 2R and left upper sleeve 2L are constructed of highly absorbent material, such as uncut pile stretch terry cloth. A suitable composition is 60% cotton, 20% polyester, and 20% lycra. This composition does not restrict arm movement.

Referring to FIGS. 3 and 4, there are shown front and rear views, respectively, of alternate embodiments of the invention in which the absorbent material is limited to a front panel 2F of the sleeve.

Another embodiment comprises a panel of absorbent material 2H attached to the front of sleeve 2 of the jersey by fasteners such as hook-and-loop fasteners, snaps, elastic bands or other suitable fasteners. Sleeve bands 3R and 3L are preferably made from cotton/-polyester rib knit with one-way stretch around the arm to allow for movement. The buttons 4 are preferably made of rubber for safety. Collar 5 is also preferably made of a cotton/polyester rib knit with one-way stretch around the neck to allow for comfort and movement. The lower portion 6 of the jersey is preferably cut with a shirt tail to allow for extra comfort and movement through the hip area.

Other embodiments are within the claims.

With is claimed is:

1. A jersey or shirt of lightweight material having left and right sleeves each having a front panel with moisture-absorbent material at least on the front panel of at least one sleeve covering at least the biceps region so that a person can easily use the moisture-absorbent material to wipe facial sweat, the moisture absorbing capacity of said moisture-absorbent material being significantly greater than that of said lightweight material.

2. A jersey or shirt in accordance with claim 1 wherein said moisture-absorbent material is terry cloth.

3. A jersey or shirt in accordance with claim 2 wherein said terry cloth is stretch terry cloth.

4. A jersey or shirt in accordance with claim 3 wherein said stretch terry cloth is a composition of substantially 60% cotton, 20% polyester and 20% lycra.

5. A jersey or shirt in accordance with claim 1 wherein said at least one sleeve is made of said moisture-absorbent material.

6. A jersey or shirt in accordance with claim 2 wherein said at least one sleeve is made of said moisture-absorbent material.

7. A jersey or shirt in accordance with claim 3 wherein said at least one sleeve is made of said moisture-absorbent material.

8. A jersey or shirt in accordance with claim 4 wherein said at least one sleeve is made of said moisture-absorbent material.

9. A jersey or shirt in accordance with claim 1 wherein only the front panel of said at least one sleeve has said moisture-absorbent material.

10. A jersey or shirt in accordance with claim 2 wherein only the front panel of said at least one sleeve has said moisture-absorbent material.

11. A jersey or shirt in accordance with claim 3 wherein only the front panel of said at least one sleeve has said moisture-absorbent material.

12. A jersey or shirt in accordance with claim 4 wherein only the front panel of said at least one sleeve has said moisture-absorbent material.

13. A jersey or shirt in accordance with claim 1 wherein said moisture-absorbent material comprises a removable panel, and a fastener detachably securing said moisture-absorbent material to said at least on sleeve.

14. A jersey or shirt in accordance with claim 2 wherein said moisture-absorbent material comprises a removable panel, and a fastener detachably securing said moisture-absorbent material to said at least one sleeve.

15. A jersey or shirt in accordance with claim 3 wherein said moisture-absorbent material comprises a removable panel, and a fastener detachably securing said moisture-absorbent material to said at least one sleeve.

16. A jersey or shirt in accordance with claim 4 wherein said moisture-absorbent material comprises a removable panel, and a fastener detachably securing said moisture-absorbent material to said at least one sleeve.

* * * * *